US008630556B2

(12) United States Patent
Yamada

(10) Patent No.: US 8,630,556 B2
(45) Date of Patent: Jan. 14, 2014

(54) FIXING DEVICE AND IMAGE FORMING APPARATUS INCLUDING SAME

(75) Inventor: Masamichi Yamada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 184 days.

(21) Appl. No.: 13/036,562

(22) Filed: Feb. 28, 2011

(65) Prior Publication Data

US 2011/0222881 A1 Sep. 15, 2011

(30) Foreign Application Priority Data

Mar. 15, 2010 (JP) ..... 2010-058517

(51) Int. Cl.
*G03G 15/20* (2006.01)
*G03G 15/00* (2006.01)
*G03G 15/16* (2006.01)

(52) U.S. Cl.
USPC ..... 399/45; 399/122; 399/329

(58) Field of Classification Search
USPC ..... 399/45, 122
See application file for complete search history.

(56) References Cited

U.S. PATENT DOCUMENTS

| | | | | |
|---|---|---|---|---|
| 6,088,558 | A | 7/2000 | Yamada et al. | |
| 6,091,926 | A | 7/2000 | Yamada | |
| 6,351,619 | B1 | 2/2002 | Yamada | |
| 6,377,776 | B1 * | 4/2002 | Orchard et al. | 399/328 |
| 6,553,204 | B1 | 4/2003 | Yamada | |
| 6,577,840 | B2 | 6/2003 | Hachisuka et al. | |
| 6,865,363 | B2 | 3/2005 | Hachisuka et al. | |
| 6,925,280 | B2 | 8/2005 | Yamada | |
| 7,190,921 | B2 * | 3/2007 | Ishii et al. | 399/111 |
| 7,228,096 | B2 | 6/2007 | Yamada | |
| 7,359,664 | B2 | 4/2008 | Yamada | |
| 7,428,390 | B2 * | 9/2008 | Ando | 399/67 |
| 7,653,321 | B2 * | 1/2010 | Yoshikawa | 399/67 |
| 7,751,768 | B2 | 7/2010 | Yamada | |
| 7,890,039 | B2 | 2/2011 | Yamada | |

(Continued)

FOREIGN PATENT DOCUMENTS

| | | |
|---|---|---|
| JP | 63-221373 | 9/1988 |
| JP | 2003-15459 | 1/2003 |

(Continued)

OTHER PUBLICATIONS

Office Action issued Oct. 22, 2013, in Japanese Patent Application No. 2010-058517.

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

A fixing device for fixing a toner image on a recording medium includes a fixing roller to rotate in a predetermined direction of rotation, a pressing roller to rotate and contact an outer circumferential surface of the fixing roller to form a nip between the pressing roller and the fixing roller through which the recording medium bearing the toner image passes to fix the toner image by heat and pressure, a pressing lever to hold both lateral end portions of the pressing roller, and a cam disposed on a camshaft, to rotate the pressing lever to change the position of the pressing roller. Rotation of the cam in a first, pressing direction enables the pressing roller to pressingly contact the fixing roller. Rotation of the cam in a second direction opposite the pressing direction enables the pressing roller to separate from the fixing roller.

15 Claims, 13 Drawing Sheets

(56) References Cited

U.S. PATENT DOCUMENTS

| | | | | |
|---|---|---|---|---|
| 8,023,861 | B2 * | 9/2011 | Yoshinaga et al. | 399/122 |
| 8,064,798 | B2 * | 11/2011 | Shinshi et al. | 399/122 |
| 8,068,765 | B2 * | 11/2011 | Kagawa | 399/122 |
| 2002/0118982 | A1 * | 8/2002 | Fuma | 399/329 |
| 2002/0176724 | A1 * | 11/2002 | Fuma et al. | 399/328 |
| 2004/0252354 | A1 * | 12/2004 | Shimizu | 358/496 |
| 2005/0254846 | A1 * | 11/2005 | Yura et al. | 399/67 |
| 2007/0014585 | A1 * | 1/2007 | Nagasu et al. | 399/67 |
| 2007/0230983 | A1 * | 10/2007 | Nakamoto et al. | 399/69 |
| 2008/0107436 | A1 * | 5/2008 | Mikutsu | 399/67 |
| 2008/0181645 | A1 * | 7/2008 | Nakamura | 399/70 |
| 2008/0260425 | A1 * | 10/2008 | Hirayama et al. | 399/122 |
| 2009/0114510 | A1 * | 5/2009 | Chiba | 198/813 |
| 2010/0008683 | A1 * | 1/2010 | Yoshikawa | 399/45 |
| 2010/0061787 | A1 * | 3/2010 | Katayama | 399/405 |
| 2010/0158553 | A1 * | 6/2010 | Ueno | 399/67 |
| 2010/0189477 | A1 | 7/2010 | Yamada | |
| 2010/0226700 | A1 | 9/2010 | Yamada et al. | |
| 2010/0247167 | A1 * | 9/2010 | Wing | 399/302 |
| 2010/0303523 | A1 | 12/2010 | Yamada | |
| 2011/0052235 | A1 * | 3/2011 | Barton et al. | 399/69 |
| 2011/0058839 | A1 * | 3/2011 | Tsukioka | 399/67 |
| 2011/0097093 | A1 * | 4/2011 | Birumachi | 399/21 |
| 2011/0176821 | A1 * | 7/2011 | Hase | 399/45 |

FOREIGN PATENT DOCUMENTS

| | | |
|---|---|---|
| JP | 2007-079160 | 3/2007 |
| JP | 2008-165091 | 7/2008 |
| JP | 2009-198949 | 9/2009 |
| JP | 2010-002587 | 1/2010 |

* cited by examiner

FIXING DEVICE AND IMAGE FORMING APPARATUS INCLUDING SAME

CROSS-REFERENCE TO RELATED APPLICATIONS

The present application is based on and claims priority to Japanese Patent Application No. 2010-058517, filed on Mar. 15, 2010 in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, such as a copier, a facsimile machine, a printer, or a multi-functional system including a combination thereof, and more particularly, to a fixing device for fixing a toner image on a recording medium, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charging device uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a pair of looped belts or rollers, one being heated by a heater for melting toner (hereinafter referred to as "fixing member") and the other being pressed against the fixing member (hereinafter referred to as "pressing member"). In a fixing process, the fixing member and the pressing member meet and press against each other, forming a so-called a fixing nip through which a recording medium is passed to fix a toner image thereon under heat and pressure.

To extend product life of the fixing member, which is subjected to constant heat and pressure, changing the position of the pressing member is proposed. More specifically, an eccentric cam is used to change the position of the pressing member between a pressing state and a pressure-free state by rotating the eccentric cam so that the pressing member is not always in contact with the fixing member. In this configuration, a single rotation of the eccentric cam in a predetermined direction changes a pressing state of the pressing member from a pressure-free state to a pressing state, or the vice versa.

Although advantageous, a direction of moment exerted on the shaft of the eccentric cam changes as the position of the pressing roller is switched from the pressing state to the pressure-free state, thereby causing surfaces of gear teeth contacting each other and/or surfaces in a joint portion where the camshaft and a drive shaft meet to be reversed, colliding with opposite surfaces, and producing undesirable noise such as impact noise.

To prevent such noise, a mechanism such as a damper or a one-way clutch that transmits force from a driver while locking the force from the camshaft has been proposed. However, such a mechanism is generally expensive.

In another example of changing the position of the pressing member, a plurality of pressure switching cams and a plurality of arms biased by a plurality of corresponding springs are provided to both lateral end portions of the pressing roller. Rotation of a pressure release lever causes the plurality of the pressure switching cams to rotate. In this configuration, the arms separate from the pressing roller against the pressing force of the springs in accordance with the position of the pressure switching cams, and a desired fixing pressure can be selected from a plurality of pressures accompanied by the plurality of springs. Accordingly, a pressing force of the pressing roller is changed to accommodate various types and thickness of recording media sheets.

Disadvantageously, this configuration tends to be complicated, with an increase in the number of parts such as multiple arms, springs, and cams required.

BRIEF SUMMARY OF THE INVENTION

In view of the foregoing, in one illustrative embodiment of the present invention, a fixing device for fixing a toner image on a recording medium includes a fixing roller, a pressing roller, a pressing lever, and a cam. The fixing roller rotates in a predetermined direction of rotation. The pressing roller rotates and contacts an outer circumferential surface of the fixing roller to form a nip between the pressing roller and the fixing roller through which the recording medium bearing the toner image passes to fix the toner image by heat and pressure. The position of the pressing roller is changeable relative to the fixing roller. The pressing lever holds both lateral end portions of the pressing roller. The cam is disposed on a camshaft, to rotate the pressing lever to change the position of the pressing roller. Rotation of the cam in a first, pressing direction enables the pressing roller to pressingly contact the fixing roller. Rotation of the cam in a second direction opposite the pressing direction enables the pressing roller to separate from the fixing roller.

In another illustrative embodiment of the present an image forming apparatus includes the fixing device.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF THE INVENTION

Figure 1:
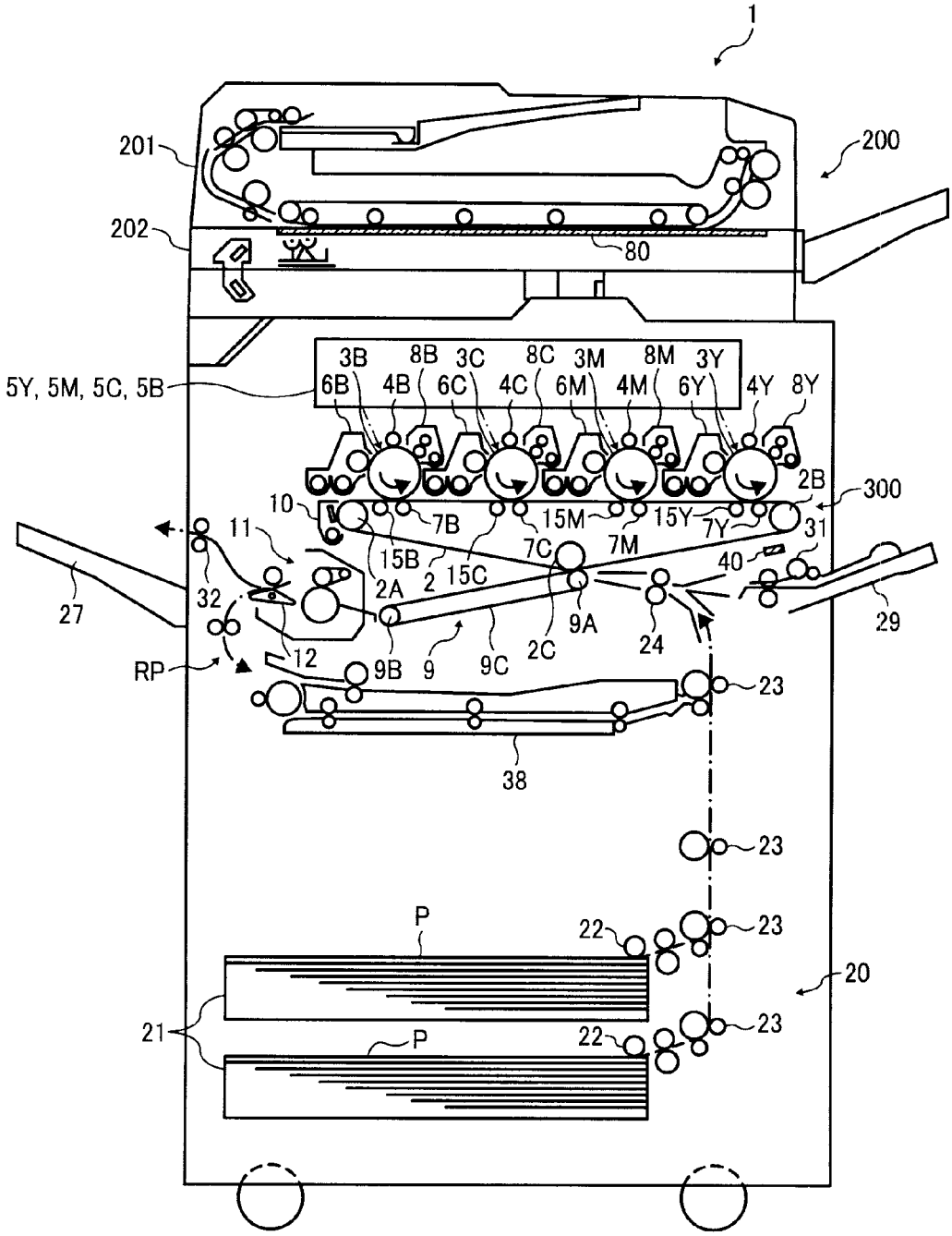
FIG. 1 is a schematic diagram illustrating an image forming apparatus according to an exemplary embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, in particular to FIG. 1, a tandem-type image forming apparatus according to an exemplary embodiment of the present invention is explained.

Referring to FIG. 1, there is provided a schematic diagram illustrating a color copier as an example of the image forming apparatus.

As illustrated in FIG. 1, an image forming apparatus 1 includes an image forming unit 300, a sheet feeding unit 20 substantially below the image forming unit 300, and an image reader 200 substantially above the image forming unit 300. The image forming unit 300 includes an intermediate transfer belt 2 having a transfer surface extending horizontally on which a toner image is transferred, and photoconductive drums 3Y, 3M, 3C, and 3B serving as image carriers arranged in tandem along the intermediate transfer belt 2 facing the transfer surface of the intermediate transfer belt 2. It is to be noted that reference characters Y, M, C, and B denote the colors yellow, magenta, cyan, and black, respectively. To simplify the description, the reference characters Y, M, C, and B indicating colors are omitted herein unless otherwise specified.

The photoconductive drums 3Y, 3M, 3C, and 3B rotate in a counterclockwise direction. Around each of the photoconductive drums 3Y, 3M, 3C, and 3B, a charging device 4, an optical writer 5, a developing device 6, a transfer bias roller 7, a voltage applicator 15, a cleaning device 8 are disposed. The charging device 4 charges the respective photoconductive drum 3 while the photoconductive drum 3 is rotated. The optical writer 5 serves as an exposure device to form an electrostatic latent image on the respective photoconductive drum 3 based on image information read by the image reader 200. The developing device 6 develops the electrostatic latent image formed on the photoconductive drum 3 with toner having the same polarity as that of the electrostatic latent image. The transfer bias roller 7 serves as a primary transfer member. In each of the developing devices 6, the respective color of toner is stored.

The intermediate transfer belt 2 is rotatably wound around and stretched between a plurality of rollers 2A, 2B, and 2C disposed in the inner loop of the intermediate transfer belt 2. The intermediate transfer belt 2 rotates in the same direction as that of the photoconductive drums 3Y, 3M, 3C, and 3B at the position facing each other. The rollers 2A and 2B support the transfer surface of the intermediate transfer belt 2. The roller 2C is disposed facing a secondary transfer unit 9 through the intermediate transfer belt 2. The image forming apparatus also includes a belt cleaning unit 10.

The photoconductive drums 3Y, 3M, 3C, and 3B all have the same configuration as all the others, differing only in the color of toner employed. Thus, a description is provided of the photoconductive drum 3Y as a representative example of the photoconductive drums. The surface of the photoconductive drum 3Y is charged uniformly by the charging device 4Y. An electrostatic latent image is formed on the photoconductive drum 3Y based on the image information read by the image reader 200.

The electrostatic latent image formed on the photoconductive drum 3Y is developed with yellow toner by the developing device 6Y to form a visible image, also known as a toner image. The developing device 6Y stores a two-component developing agent consisting of carrier and toner. Subsequently, the toner image is primarily transferred from the photoconductive drum 3Y onto the intermediate transfer belt 2 due to an electric field created by the voltage applied to the transfer bias roller 7Y.

The voltage applicator 15Y is disposed upstream from the transfer bias roller 7Y in the direction of rotation of the photoconductive drum 3Y. The voltage applicator 15Y applies a voltage same as the polarity of the photoconductive drum 3Y and an absolute value greater than when printing a solid image, to the intermediate transfer belt 2, thereby preventing toner from getting transferred undesirably from the photoconductive drum 3Y to the intermediate transfer belt 2 before the toner image enters a transfer area and thus preventing degradation of imaging quality.

Similarly, image forming operation similar to the photoconductive drum 3Y is performed with regards to the photoconductive drums 3M, 3C, and 3B, and toner images of the respective color are overlappingly transferred onto the intermediate transfer belt 2, forming a composite color toner image.

After the transfer process, toner (residual toner) remaining on the photoconductive drums 3 is removed therefrom by the cleaning device 8. In the meantime, the potential of the photoconductive drums 3 is initialized by a charge eraser after the transfer process in preparation for the subsequent imaging cycle.

The secondary transfer unit 9 includes a transfer belt 9C wound around and stretched between a drive roller 9A serving as a charger and a driven roller 9B. The transfer belt 9C moves in the same direction as that of the intermediate transfer belt 2. The drive roller 9A charges the transfer belt 9C to transfer the composite toner image formed on the intermediate transfer belt 2 onto a recording medium P.

Multiple recording media sheets P are stored in sheet cassettes 21 of the sheet feed unit 20 and fed to a secondary transfer position. An uppermost recording medium P in one of the sheet cassettes 21 is picked up by a pickup roller 22 and conveyed to sheet feed roller pairs 23 which guide the recording medium P to a registration roller pair 24 which is disposed upstream from the secondary transfer position.

The recording medium P fed from the sheet cassette 22 is temporarily stopped at the registration roller pair 24 at which the position of the recording medium P is aligned. Subsequently, the recording medium P is sent to the secondary transfer position in appropriate timing such that the recording medium P is aligned with the toner image on the intermediate transfer belt 2.

A manual feed tray 29 is foldably disposed at the right side of the image forming apparatus 1. When manually fed, the recording medium P placed on the manual feed tray 29 is conveyed to the registration roller pair 24 by a sheet feed roller 31 through the same sheet conveyance path through which the recording medium P conveyed from the sheet cassette 21 also passes.

The optical writers 5Y, 5M, 5C, and 5B illuminate the respective photoconductive drums 3Y, 3M, 3C, and 3B with light based on image information received from the image reader 200 or a computer, thereby forming electrostatic latent images on the photoconductive drums 3Y, 3M, 3C, and 3B.

The image reader 200 includes an automatic document feeder 201 and a scanner 202 which includes a contact glass 80 on which a recording medium P is placed. The automatic document feeder 201 can reverse a document to be conveyed to the contact glass 80 so that both sides of the document are scanned.

The electrostatic latent images formed on the photoconductive drums 3 by the respective optical writers 5 are developed with respective color of toner by the developing devices 6, thereby forming a visible image, also known as a toner image, on the photoconductive drums 3. Subsequently, the toner images are overlappingly and primarily transferred onto the intermediate transfer belt 2, forming a composite toner image. Then, the secondary transfer unit 9 secondarily transfers the composite toner image onto the recording medium P. The recording medium P bearing the toner image is sent to a fixing device 11 in which the toner image, also called an unfixed image, is fixed onto the recording medium P by heat and pressure.

The residual toner remaining on the intermediate transfer belt 2 after the secondary transfer process is cleaned by the belt cleaning device 10.

The recording medium P passed through the fixing device 11 is guided to either a conveyance path leading to a catch tray 27 or a reverse path RP by a switching claw 12. In a case in which the recording medium P is conveyed to the catch tray 27, the recording medium P is discharged to and stacked on the catch tray 27 by a pair of discharge rollers 32. By contrast, in a case in which the recording medium P is conveyed to the reverse path RP, the recording medium P is turned by a sheet reverse unit 38 and is sent to the registration roller pair 24.

When forming a single-color image, a single-color toner image is transferred on the intermediate transfer belt 2 and then transferred onto the recording medium P fed from the sheet cassette 21. By contrast, when forming a multi-color toner image, toner images of different colors are overlappingly transferred onto the intermediate transfer belt 2 and then transferred secondarily onto the recording medium P. After the secondary transfer process, the unfixed toner image is fixed by the fixing device 11 and discharged onto the catch tray 27, or is reversed for forming an image on the other side of the recording medium P.

It is to be noted that a reference number 40 refers to a density detector to detect a density of the toner pattern.

Figure 2:
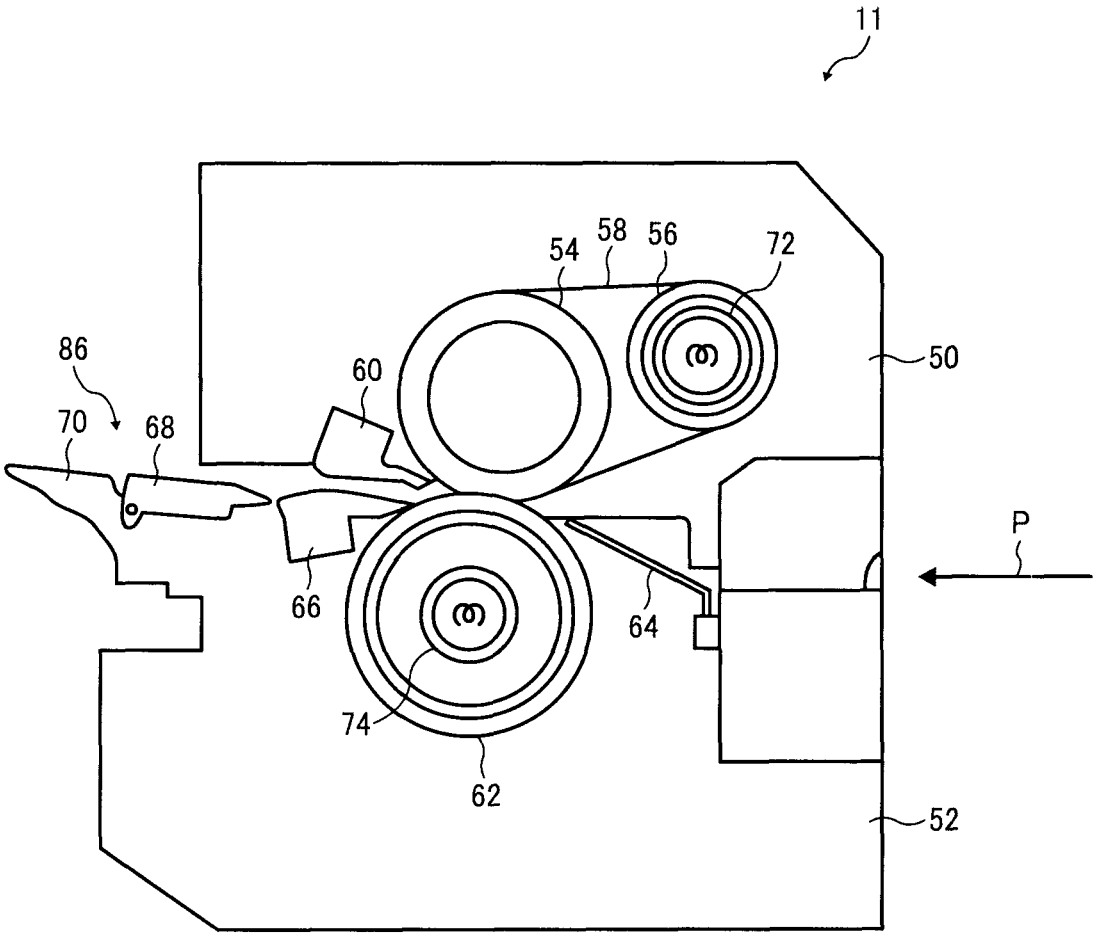
FIG. 2 is a schematic diagram illustrating a fixing device according to an illustrative embodiment of the present invention, employed in the image forming apparatus shown in FIG. 1.

With reference to FIGS. 1 and 2, a description is provided of a fixing device 11 according to the illustrative embodiment of the present invention. FIG. 2 is a schematic diagram illustrating the fixing device 11, according to the illustrative embodiment of the present invention.

As illustrated in FIG. 2, the fixing device 11 includes an upper unit 50 and a lower unit 52. The upper unit 50 includes a first separation plate 60, a fixing roller 54, a heating roller 56, a fixing belt 58 wound around and stretched between the fixing roller 54, the heating roller 56, and so forth.

The lower unit 52 includes a pressing roller 62, a sheet guide 64, a second separation plate 66 serving as a sheet separator for separating a recording medium rolled around the pressing roller 62, a sheet discharge assembly 86 serving as a sheet discharger, and so forth. The sheet discharge assembly 86 includes a relay guide 68 and a sheet discharge guide 70. The second separation plate 66, the relay guide 68, the sheet discharge guide 70 have a length similar to, if not the same as, a shaft of the pressing roller 62, extending in an axial direction of the pressing roller 62. The relative positions of the sheet guide 64 and the second separation plate 66 relative to the pressing roller 62 do not change even when the pressing roller 62 moves.

The pressing roller 62 is pressed against the fixing roller 54 through the fixing belt 58, thereby forming a nip between the pressing roller 62 and the fixing belt 58 through which a recording medium P is conveyed. A halogen heater 72 serving as a heat source is disposed in the heating roller 56. A halogen heater 74 is disposed in the pressing roller 62. The halogen heater 72 includes multiple heaters. An amount of heat of the halogen heater 72 is adjusted by selecting a number of power distribution wires.

The recording medium P bearing an unfixed toner image is conveyed to the nip portion from the right side in FIG. 2. In the nip portion, heat and pressure are applied to the recording medium, thereby fixing the unfixed toner image on the recording medium.

The fixing belt 58 includes a base layer formed of polyimide resin having an internal diameter of approximately 80 mm and a thickness of approximately 90 μm. A silicon rubber layer having a thickness of approximately 200 μm is provided on the base layer. The silicon rubber layer is coated with tetrafluoroethylene-perfluoroalkylvinylether copolymer (hereinafter PFA) having a thickness of approximately 20 μm as an outermost surface.

The fixing roller 54 includes a heat-resistant elastic layer formed of, for example, silicon rubber having an outer diameter of approximately 52 mm and a thickness of approximately 14 mm.

The heating roller 56 is constructed of a metal hollow tube, for example, an aluminum tube, having an outer diameter of approximately 40 mm and a thickness of approximately 0.6 mm.

The pressing roller 62 is constructed of a metal hollow core including metal material such as copper having a thickness of approximately 1 mm and an outer diameter approximately 65 mm. On the metal core, a silicon rubber layer having a thickness of approximately 1.5 mm is provided. On the silicon rubber layer, a tube made of PFA is provided.

Figure 3:
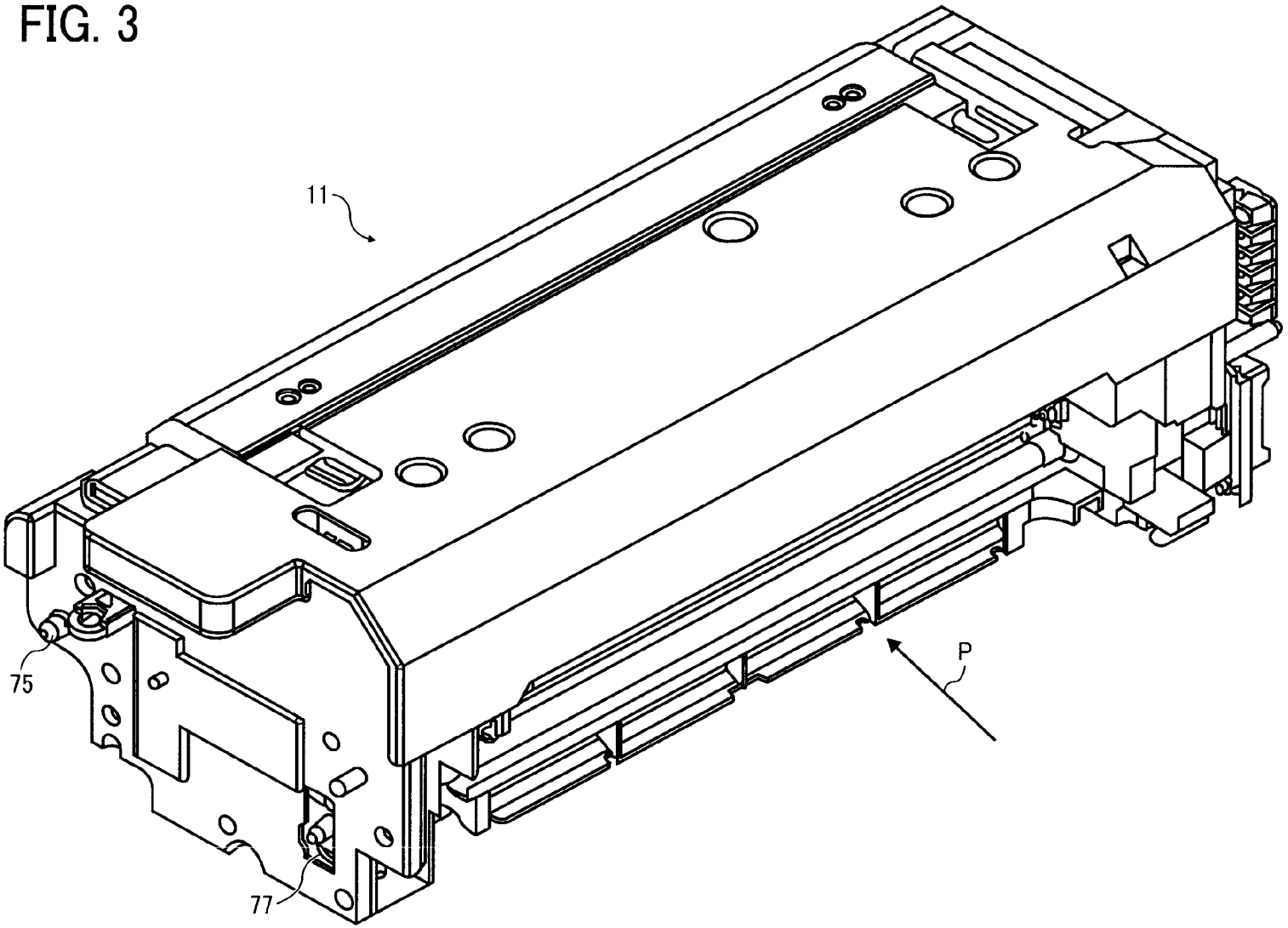
FIG. 3 is an external perspective view of the fixing device of FIG. 2.
Figure 4:
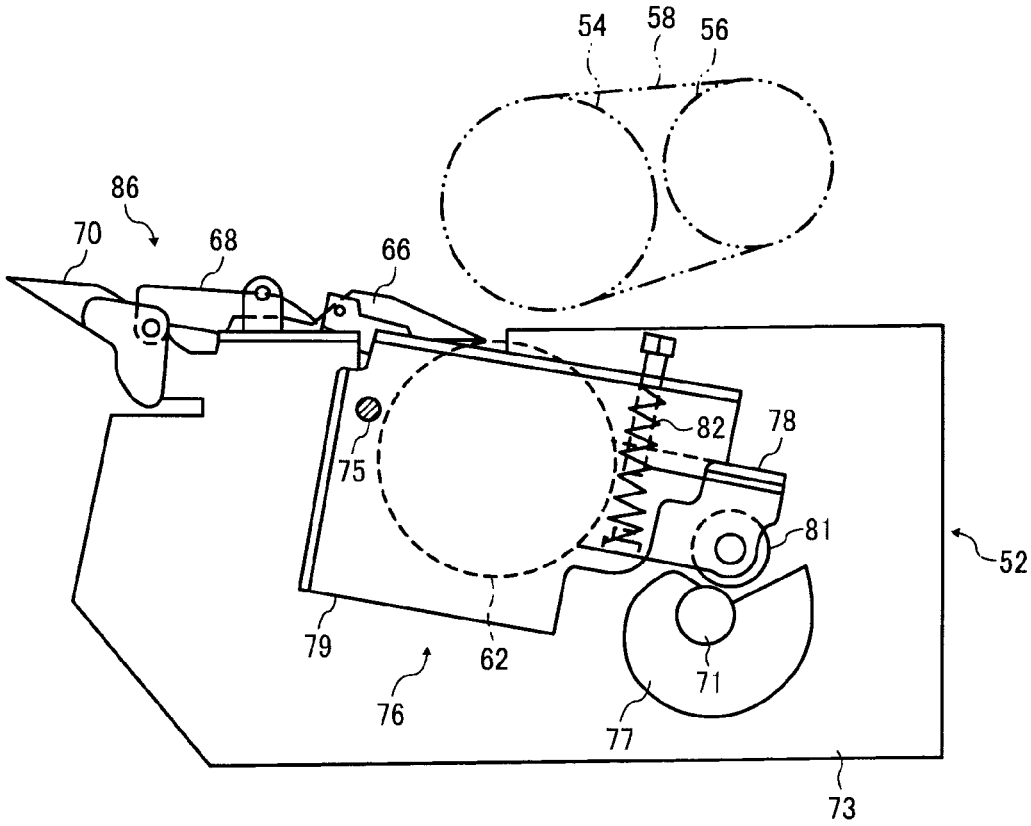
FIG. 4 is a schematic diagram illustrating a lower unit of the fixing device in a pressure-free state.

With reference to FIGS. 3 and 4, a description is provided of the fixing device 11 in more detail. FIG. 3 is an external perspective view of the fixing device 11. FIG. 4 is a schematic diagram illustrating the lower unit 52 of the fixing device 11 in a pressure-free state when the pressing roller 62 is separated from the fixing belt 58. "Pressure-free state" herein refers to either the pressing roller 62 being separated from the fixing belt 58 or the pressing roller 62 contacting the fixing belt 58 without pressure.

In FIG. 4, the lower unit 52 of the fixing device 11 includes a lower frame 73 and a pressing roller assembly 76. The position of the lower frame 73 is fixed. The pressing roller assembly 76, provided to the lower frame 73, holds the pressing roller 62, and is vertically rotatable about a shaft 75. The pressing roller assembly 76 is rotated by a cam 77 provided to the lower frame 73.

The cam 77 is fixed to a camshaft 71 and rotated by a drive source through a joint. The cam 77 is rotated in a clockwise direction, enabling the pressing roller assembly 76 to rotate upward so that the pressing roller 62 contacts the fixing roller 54 with pressure. By contrast, when the cam 77 is rotated in an opposite direction (counterclockwise), the pressing roller 62 moves from its pressing position to the pressure-free position.

The pressing roller assembly 76 includes an internal lever 78 and an external lever 79 substantially at both lateral ends of the pressing roller 62 in the width direction. The internal lever 78 is driven directly by the cam 77. The external lever 79 supports the lateral end of the pressing roller 62 through a shaft bearing. Both the internal lever 78 and the external lever 79 rotate about the shaft 75. The internal lever 78 and the external lever 79 constitute a pressing lever.

The internal lever 78 includes a bearing 81 serving as a roller that contacts the cam surface of the cam 77. The pressing roller assembly 76 includes the second separation plate 66. The pressing roller assembly 76 and the second separation plate 66 are constituted as a single integrated member. The sheet discharge assembly 86 is provided to the lower frame 73.

Figure 5:
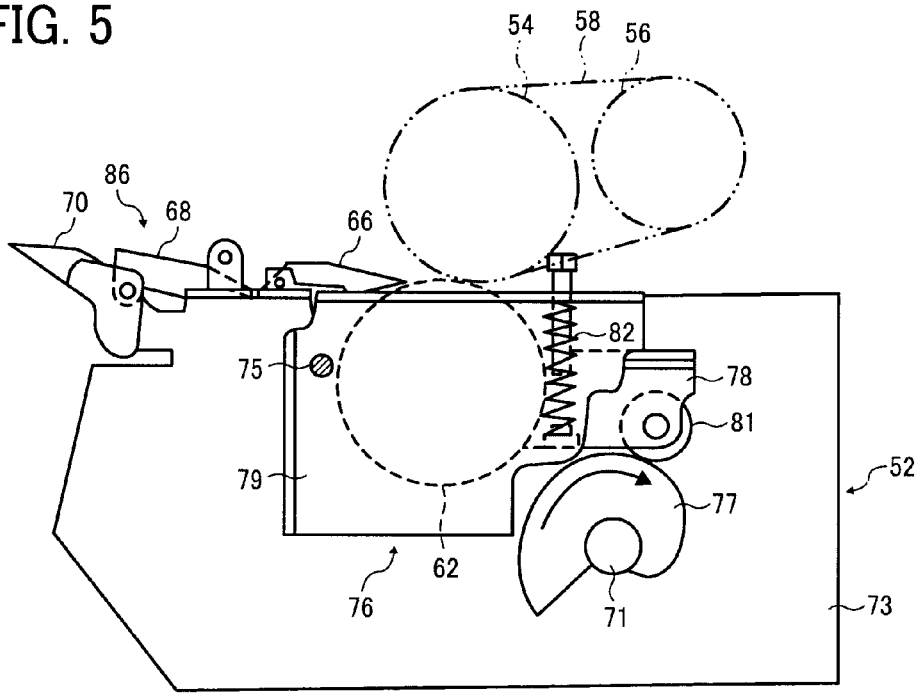
FIG. 5 is a schematic diagram illustrating the lower unit of FIG. 4 in a first pressing state in which a thin recording medium, a no-coating sheet, and the like is fixed.

The cam 77 has a shape that allows the cam surface to rise gradually as the cam 77 rotates in the direction indicated by an arrow in FIG. 5. Rotation of the cam 77 adjusts an extent of engagement of the pressing roller 62 against the fixing roller 54 through the fixing belt 58 and a width of the nip portion steplessly.

A coil spring 82 serving as a bias member is provided between the internal lever 78 and the external lever 79. The coil spring 82 acts in the direction of the pressing roller 62 pressing against the fixing roller 54 when the pressing roller 62 contacts the fixing roller 54 to press against the fixing roller 54. A description of the coil spring 82 is provided later.

Rotation of the cam 77 in the clockwise direction in the state illustrated in FIG. 4, that is, in the pressure-free state, causes the pressing roller assembly 76 to rotate in the counterclockwise direction about the shaft 75 as illustrated in FIG. 5, enabling the pressing roller 62 to pressingly contact the fixing roller 54 through the fixing belt 58, forming the nip portion therebetween. FIG. 5 is a schematic diagram illustrating the lower unit 52 of the fixing device 11 in a first pressing state suitable for fixing, for example, a thin recording medium, a no-coating sheet, and the like.

As will be later described, a home position detector 103 (shown in FIG. 1A) is provided to detect a home position of the cam 77. An amount of rotation of the cam 77 is obtained based on how much the cam 77 is rotated from its home position. Based on the amount of rotation from the home position, the "pressure-free" state is changed to the first pressing state. If a stepping motor is employed as the drive source for the cam 77, for example, rotation of the cam 77 is adjusted based on the predetermined number of steps.

Figure 6:
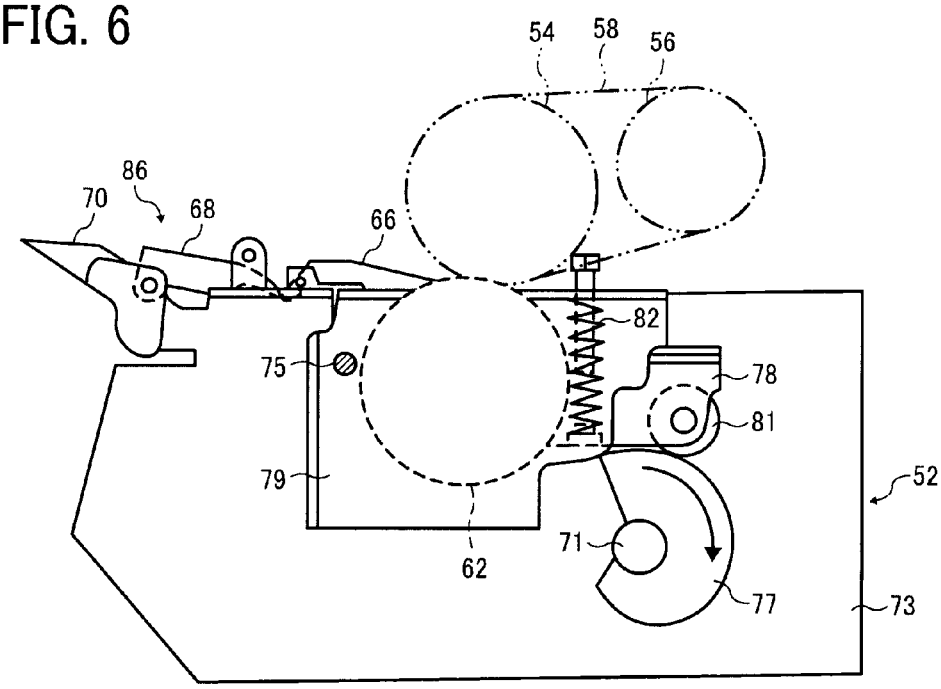
FIG. 6 is a schematic diagram illustrating the lower unit of the fixing device in a second pressing state in which a relatively thick recording medium, a coated sheet, and the like is fixed.

Furthermore, when the cam 77 is rotated in the clockwise direction further, the amount of engagement of the pressing roller 62 relative to the fixing roller 54 increases, thereby increasing the width of the nip portion as illustrated in FIG. 6. FIG. 6 is a schematic diagram illustrating the lower unit 52 of the fixing device 11 in a second pressing state suitable for fixing, for example, a relatively thick recording medium, a coated sheet, and the like. The similar, if not the same operation as described above, is performed to change the first pressing state to the second pressing state.

Figure 7:
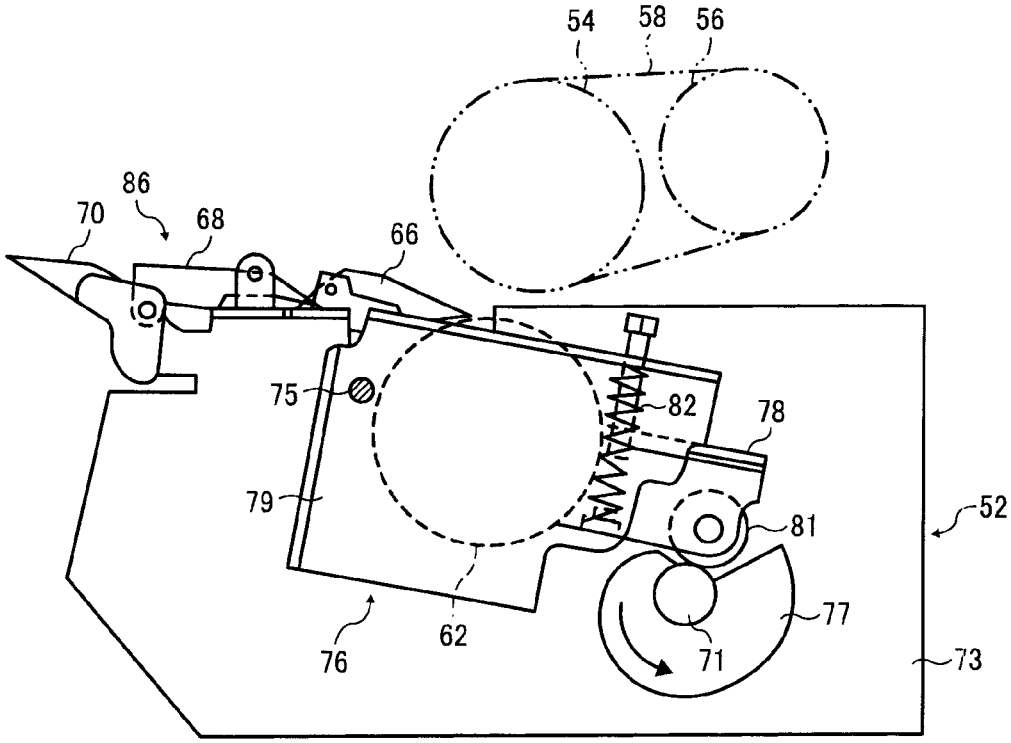
FIG. 7 is a schematic diagram illustrating the lower unit in the pressure-free state, recovered from the first pressing state illustrated in FIG. 5 or the second pressing state illustrated in FIG. 6.

With reference to FIG. 7, a description is provided of a movement of the cam 77. FIG. 7 is a schematic diagram illustrating the cam 77 in the pressure-free state recovered from the first pressing state illustrated in FIG. 5 or the second pressing state illustrated in FIG. 6.

As illustrated in FIG. 7, the cam 77 rotates in the counterclockwise direction to change the pressing roller 62 from the first or the second pressing state to the pressure-free state.

Rotation of the cam 77 in the clockwise direction enables the pressing roller 62 to move towards the fixing roller 54 to contact the fixing roller 54. By contrast, rotation of the cam 77 in the counterclockwise direction enables the pressing roller 62 to separate from the fixing roller 54, that is, the pressing roller 62 is in the pressure-free state. The highest position of the cam surface from the center of the camshaft 71 does not exceed the contact portion with the bearing 81. Thus, the direction of moment acting on the camshaft 71 is in the counterclockwise direction in both the pressing states and the pressure-free state. In other words, the direction of moment acting on the camshaft 71 does not change even when the pressing state changes to the pressure-free state, thereby preventing a gap from appearing between the gear teeth, and in the joint portion of the camshaft 71 and the drive shaft at the drive source. Accordingly, undesirable noise such as impact noise is not produced.

Figure 8:
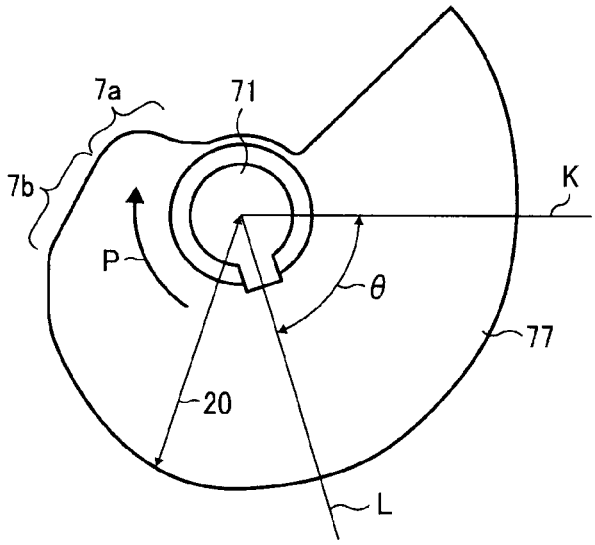
FIG. 8 is a schematic diagram illustrating a cam according to an illustrative embodiment of the present invention, employed in the fixing device.

Referring now to FIG. 8, a description is provided of the shape of the cam 77. FIG. 8 is a schematic diagram illustrating the cam 77 according to the illustrative embodiment of the present invention.

As illustrated in FIG. 8, the cam 77 includes an initial contact portion 7*a* and a substantially flat portion 7*b*. The initial contact portion 7*a* has a smooth, curved surface and is provided at a place where the cam 77 starts to contact the bearing 81 from the pressure-free state. The substantially flat portion 7*b* is provided downstream from the initial contact portion 7*a* in a direction of rotation of the cam 77 indicated by an arrow P, that is, the pressing direction. It is to be noted that rotation of the cam 77 in the direction of arrow P enables the pressing roller 62 to contact and press the fixing roller 54. The substantially flat portion 7*b* extends such that a cam height 20 defined by the cam surface and the center of the camshaft 71 increases gradually, thereby forming the cam surface curved as illustrated in FIG. 8. The cam height 20 is a distance between the center of rotation of the cam 77, that is, the center of the camshaft 71, and the cam surface.

A cam angle θ is an angle formed by a line L from the center of the camshaft 71 through the center of a key groove and a horizontal center line K. When the cam angle θ is 90°, the cam 77 is at its home position, that is, the pressure-free state. When the cam 77 in the pressure-free state rotates in the clockwise direction, moving the pressing roller 62 towards the fixing roller 54 into the pressing state, the pressure of the pressing roller 62 against the fixing roller 54 increases. When the pressing roller 62 arrives at a desired pressing position, the cam 77 moves in the counterclockwise direction to separate the pressing roller 62 from the fixing roller 54, returning to the pressure-free state.

Figure 9A:
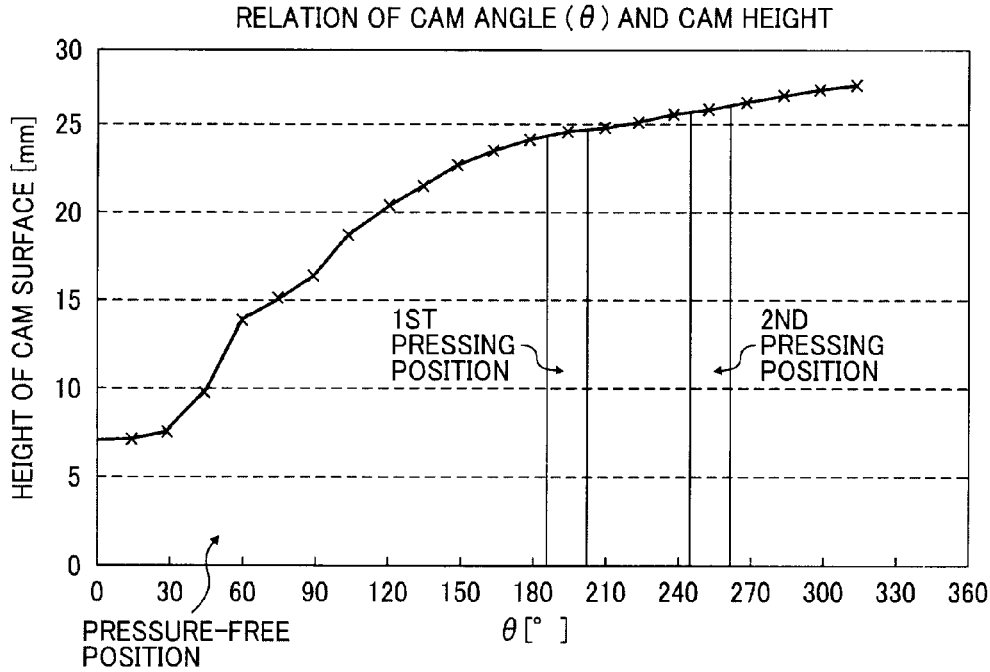
FIG. 9A is a graph showing a relation of a cam height defined as a distance from a center of a camshaft to a circumferential cam surface, and a cam angle (θ)
Figure 9B:
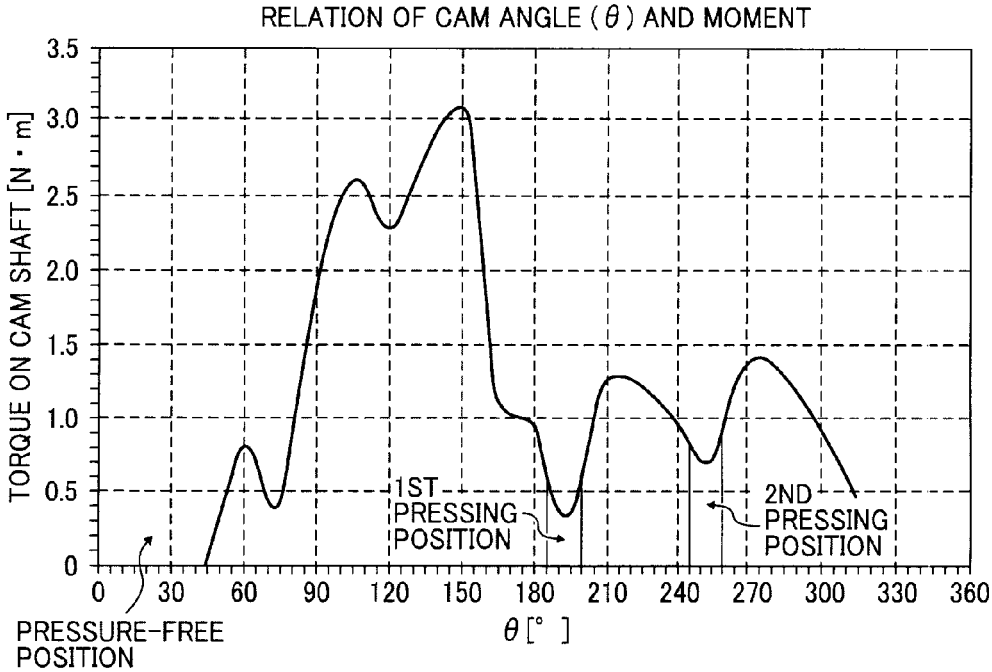
FIG. 9B is a graph showing a relation of the cam angle (θ) and moment on the camshaft (a torque N·m on the camshaft)

FIG. 9A is a graph showing a relation of the height 20 of the cam surface and the cam angle θ. As illustrated in FIG. 9A, the height 20 of the cam surface increases gradually as the cam 77 rotates in the clockwise direction. As can be understood from FIG. 9A, an amount of rotation of the cam 77 from the pressure-free state (the home position) to the pressing state ranges from a cam angle of approximately 0° to approximately 315°. FIG. 9B is a graph showing a relation of the cam angle θ and the moment (a torque N·m on the camshaft) when the cam 77 rotates in the clockwise direction. The moment acting on the camshaft 71 when the cam 77 rotates in the clockwise direction is illustrated in FIG. 9B. In FIG. 9B, the moment acting counterclockwise on the camshaft 71 is depicted as positive. In this specification, the moment acting on the camshaft 71 is defined as always positive, that is, the moment always acts in the counterclockwise direction.

If, for example, the cam 77 has a shape such that a radius from the center of rotation of the cam 77 (the cam height as described above) to the cam surface contacting the bearing 81 is the same everywhere, then the moment acting on the camshaft 71 is 0. In such a configuration, a gap may appear between the gear teeth, and between the joint portion of the camshaft 71 and the drive shaft, thereby producing undesirable noise such as impact noise.

By contrast, according to the illustrative embodiment, the shape of the cam 77 illustrated in FIG. 8 enables the moment in the counterclockwise direction to act on the camshaft 71 of the cam 77. Hence, in the pressing state, the gap is prevented from appearing between the gear teeth, and between the joint portion of the camshaft 71 and the drive shaft, preventing the noise.

Figure 10:
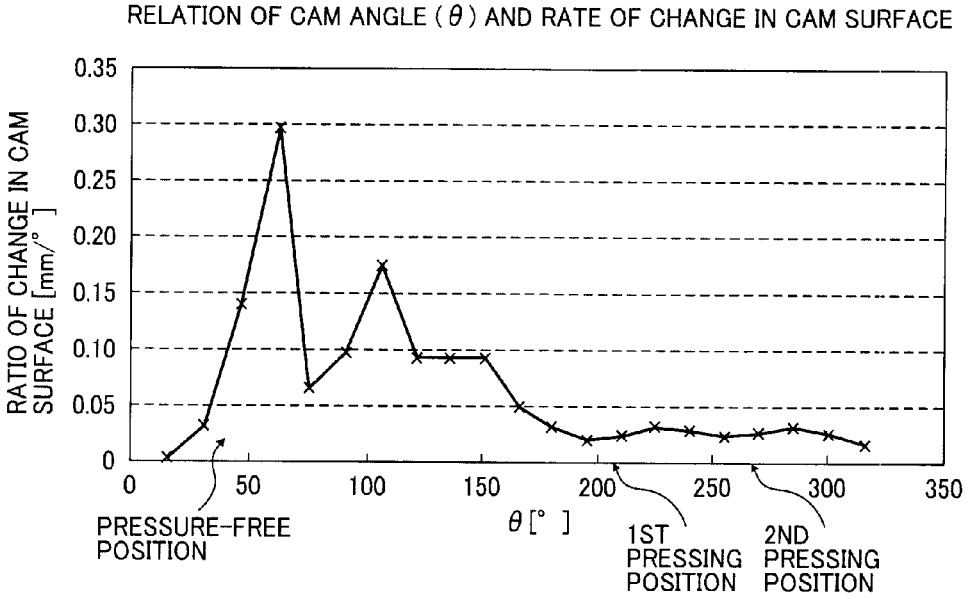
FIG. 10 is a graph showing a relation of the cam angle (θ) and a rate of change of the height of the cam surface.

With reference to FIG. 10, a description is provided of a relation of a rate of change in the height 20 of the cam surface of the cam 77 illustrated in FIG. 8 and the cam angle (θ). FIG. 10 is a graph showing a relation of the cam angle (θ) and the rate of change in the height of the cam surface. The rate of change in the height 20 of the cam surface refers to the change in the height of the cam surface with each 1 degree of change in the cam angle θ.

As can be understood from FIG. 10, the rate of change in the height of the cam surface is equal to or less than 0.05 mm as the cam 77 rotates by 1 degree in the pressing states, that is, the first pressing state and the second pressing state, when the recording medium is passed through the nip. In other words, the rate of change in the height of the cam surface at the contact positions and in the proximity thereof is relatively small, and the corresponding moment relative to the camshaft 71 is shown in FIG. 9B. As shown in FIG. 9B, the moment acting on the camshaft 71 is equal to or less than 1.0 N·m. Accordingly, load on a drive motor that drives the camshaft 71, the joint portion, and the gear is reduced. Furthermore, although not significant, the moment in the counterclockwise direction still acts on the camshaft 71. In this configuration, a gap is prevented from appearing between the gear teeth, and the joint portion of the camshaft 71 and the drive shaft.

Figure 11A:
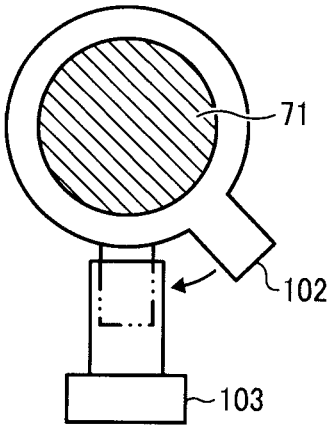
FIG. 11A is a schematic diagram illustrating a detector for detection of a home position of the cam according to an illustrative embodiment of the present invention.
Figure 11B:
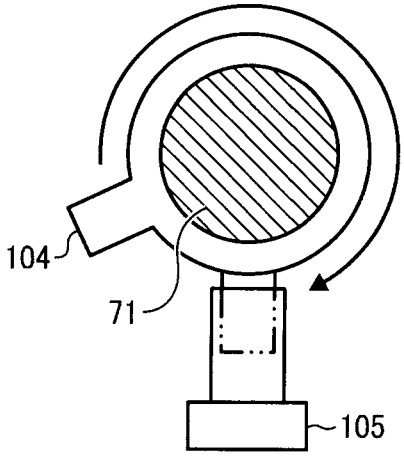
FIG. 11B is a schematic diagram illustrating a detector for detection of an upper limit position of the cam according to an illustrative embodiment of the present invention.

Referring now to FIGS. 11A and 11B, a description is provided of detection of the position of the cam 77. FIG. 11A is a schematic diagram illustrating a detector for detection of the home position of the cam 77. FIG. 11B is a schematic diagram illustrating a detector for detection of an upper limit position of the cam 77.

As illustrated in FIG. 11A, a feeler 102 for detection of the position of the cam 77 is provided to one end of the camshaft 71 extending in the axial direction of the pressing roller 62. The feeler 102 and the camshaft 71 may be constituted as a single integrated member. A home position (HP) detector 103 for detecting the feeler 102 is provided to the lower frame 73. The home position detector 103 is a transmission-type detector serving as a cam position detector.

As illustrated in FIG. 11B, a feeler 104 for detection of an upper limit position of the cam 77 is provided at the other end of the camshaft 71. The feeler 104 and the camshaft 71 may be constituted as a single integrated member. An upper limit position detector 105 for detecting the feeler 104 is provided to the lower frame 73. The upper limit position detector 105 is a transmission-type detector serving as a detector for detecting the upper limit position of the cam 77.

The camshaft 71 is driven by a drive source 106 (shown in FIG. 12), such as a stepping motor or a servomotor, provided to the lower frame 73. According to the illustrative embodiment, the home position of the cam 77 and the upper limit position of the cam 77 are detected separately by different detectors as described above. Alternatively, the home position and the upper limit position of the cam 77 may be detected using a single detector.

Figure 12:
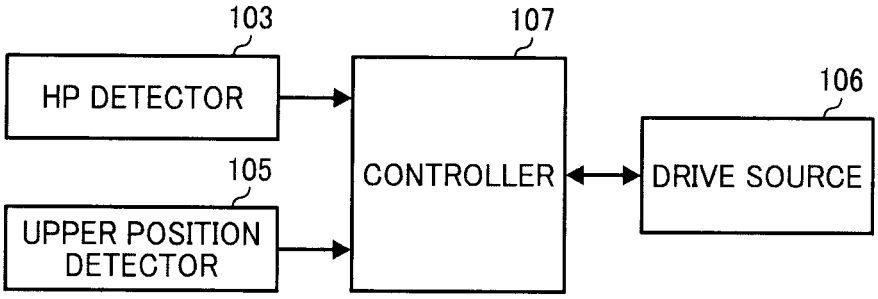
FIG. 12 is a block diagram illustrating control of the cam according to an illustrative embodiment of the present invention.

In the pressure-free state, the feeler 102 blocks the home position detector 103, and a signal indicating the pressure-free position is provided to a controller 107 such as CPU as illustrated in FIG. 12. FIG. 12 is a block diagram illustrating control of the cam 77. Based on the home position detected by the home position detector 103, the controller 107 drives the camshaft 71 for a number of pulses or for a certain period of time required to achieve a desired pressing position. With this configuration, the pressing roller 62 is positioned at the first pressing state as illustrated in FIG. 5 or at the second pressing state as illustrated in FIG. 6, thereby changing the nip width and the nip pressure in accordance with the type and the thickness of the recording medium to fix a toner image thereon under an optimum fixing condition.

Rotation of the camshaft 71 in the pressing direction causes an amount of engagement of the pressing roller 62 with respect to the fixing roller 54 to increase. If the camshaft 71 remains rotating, thereby exceeding the second pressing state illustrated in FIG. 6, the position of the cam 77 switches to the pressure-free state at once as illustrated in FIG. 8, producing impact noise. To address this problem, the upper limit position detector 105 is provided to detect the upper limit position of the cam 77 when the camshaft 71 rotates more than a predetermined permissible range, for example, the second pressing state.

When the feeler 104 blocks the upper limit position detector 105, a signal indicating detection of the cam 77 reaching its upper limit position is provided to the controller 107. Subsequently, based on the signal, the controller 107 reports an error, either by flashing lights or some other graphic or textual display, or the controller 107 stops rotation of the camshaft 71 based on the signal and then rotates the camshaft 71 in an opposite direction (in the direction in which the cam 77 returns to the pressure-free state), thereby moving the pressing roller 62 to a proper pressing position. Accordingly, the impact noise is prevented.

Figure 13:
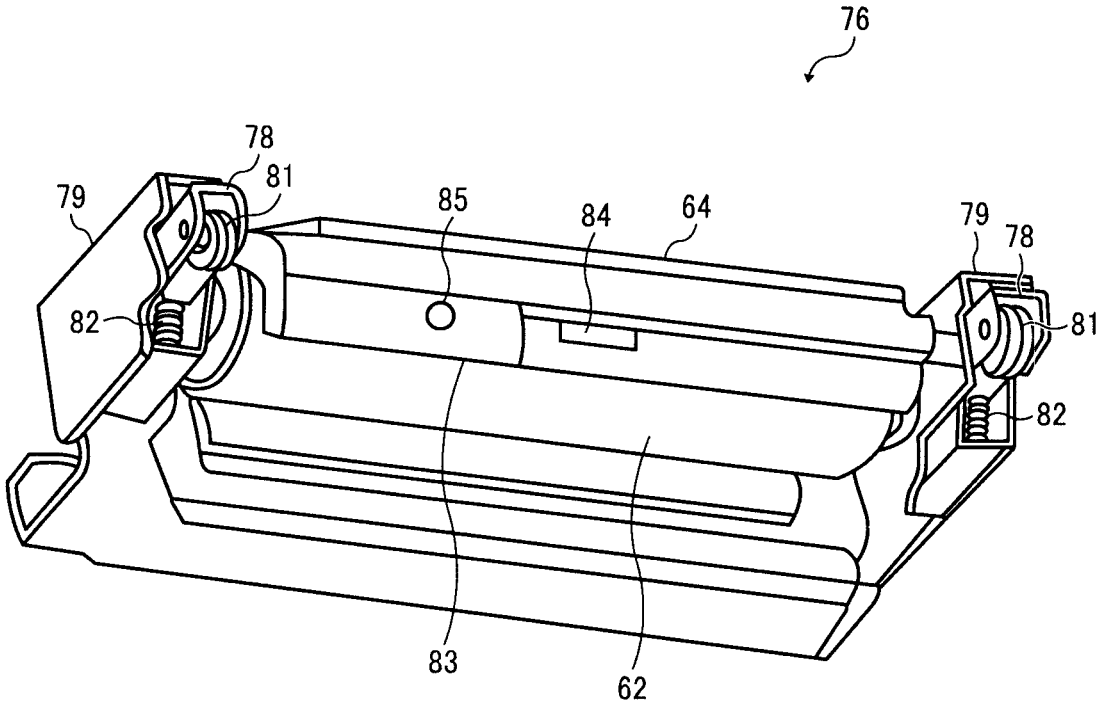
FIG. 13 is a perspective view of a pressing roller assembly as viewed from the bottom thereof, employed in the fixing device according to an illustrative embodiment of the present invention.

The pressing roller assembly 76 is detachable from the lower frame 73 of the lower unit 52 of the fixing device 11 as illustrated in FIG. 13. FIG. 13 is a perspective view of the pressing roller assembly 76 as viewed from the bottom thereof. As illustrated in FIG. 13, the internal lever 78, the external lever 79, the bearing 81, the coil spring 82, and the cam 77 for rotation of the pressing roller unit 76 are disposed substantially at both ends of the shaft of the pressing roller 62 in the axial direction of the pressing roller 62.

As described above, the pressing roller assembly 76 includes the sheet guide 64, the second separation plate 66, and an electric component module 83. The sheet guide 64, the second separation plate 66 serving as a sheet separator, and the electric component module 83 may constitute a single integrated unit as the pressing roller assembly 76 so that the relative positions thereof with respect to the pressing roller 62 do not change even when the pressing roller 62 moves.

The electric component module 83 includes a contactless thermistor 84 and a thermostat 85. The thermistor 84 is a temperature detector to detect the temperature of the surface of the pressing roller 62. The thermostat 85 prevents the pressing roller 62 from getting overheated. The relative positions of the thermistor 84 and the thermostat 85 relative to the pressing roller 62 do not change even when the pressing roller 62 moves.

The sheet guide 64, the second separation plate 66, the thermistor 84, and the thermostat 85 are positioned in place relative to the pressing roller 62, to perform optimally. Because the sheet guide 64, the second separation plate 66, the thermistor 84, the thermostat 85, and the pressing roller 62 constitute a single integrated unit, the relative positions of these devices do not change even when the position of the pressing roller 62 changes in accordance with types of recording media.

With this configuration, transportability of the sheet guide 64, the separation performance of the second separation plate 66, the detection performance of the thermistor 84, and prevention of overheat the thermostat 85 for are assured regardless of the position of the pressing roller 62.

Figure 14:
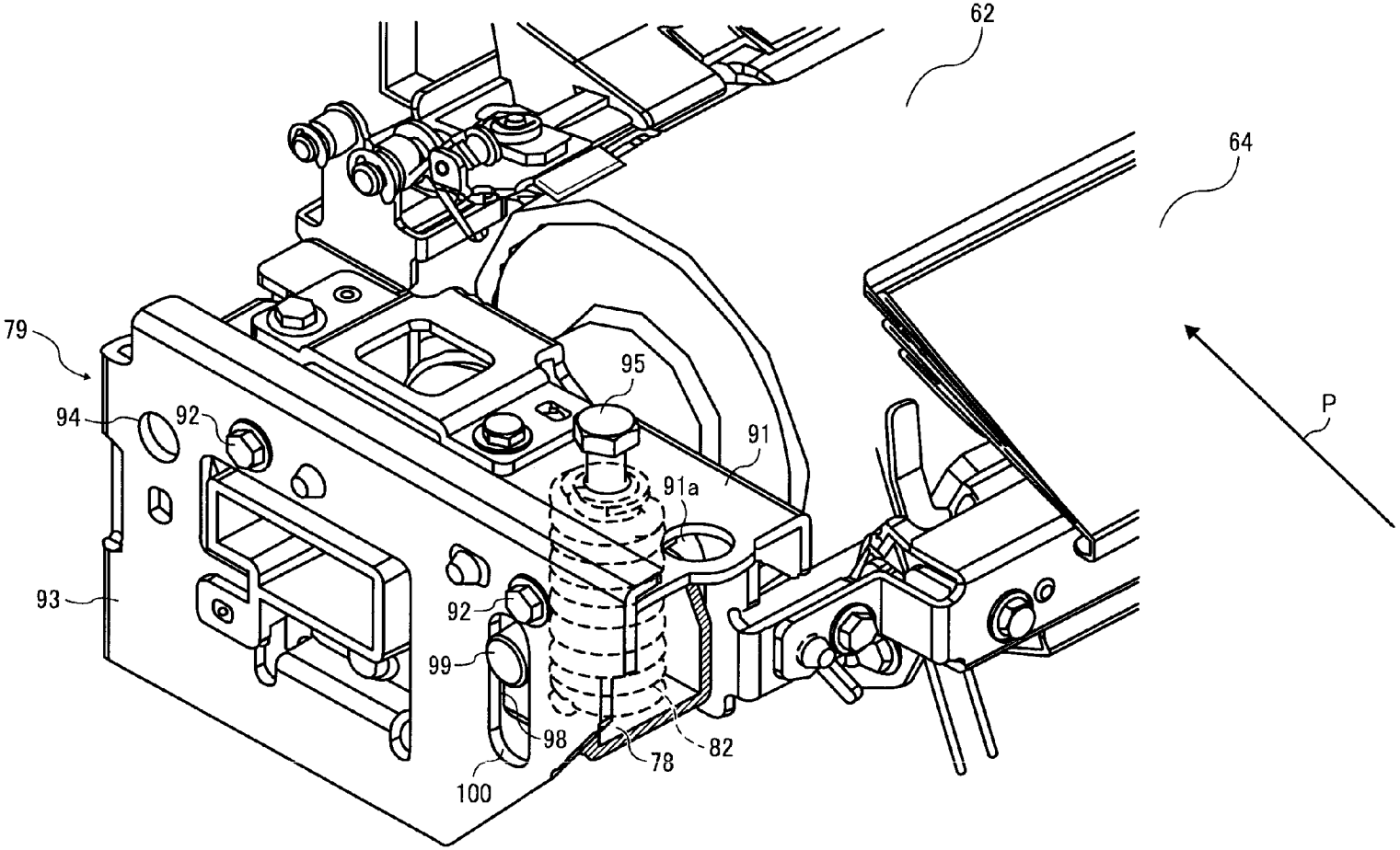
FIG. 14 is a schematic perspective view of a rotation mechanism of the pressing roller assembly.
Figure 15:
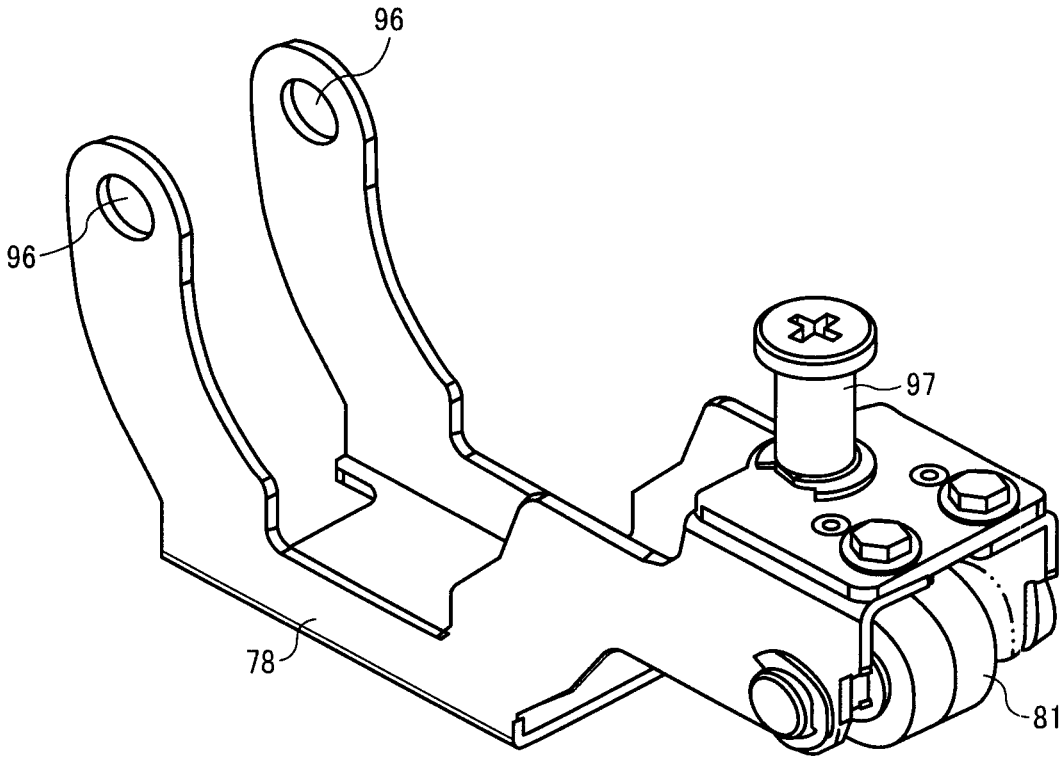
FIG. 15 is a schematic perspective view of an internal lever according to an illustrative embodiment of the present invention.
Figure 16:
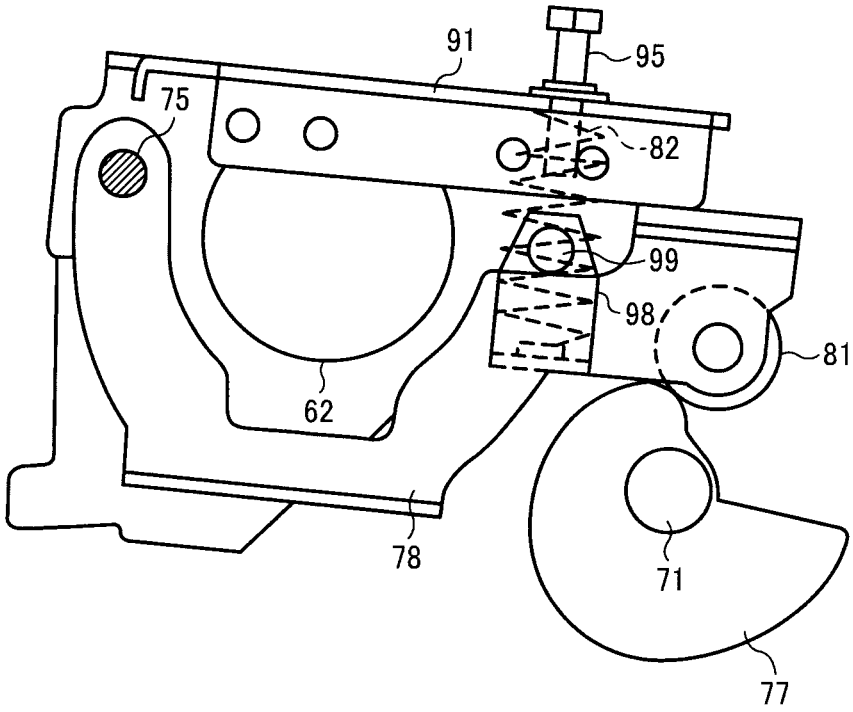
FIG. 16 is a schematic diagram illustrating a biasing mechanism according to an illustrative embodiment of the present invention.

Referring now to FIGS. 14 through 16, a description is provided of a configuration of the pressing lever including the internal lever 78 and the external lever 79 that enables rotation of the pressing roller assembly 76 using the cam 77, and a biasing mechanism of the coil spring 82, according to the illustrative embodiment.

FIG. 14 is a schematic perspective view of a rotation mechanism of the pressing roller assembly 76. FIG. 15 is a schematic perspective view of the internal lever 78. FIG. 16 is a schematic diagram illustrating the biasing mechanism.

As illustrated in FIG. 14, the external lever 79 includes an internal plate 91, an external plate 93, and a bolt 92. The internal plate 91 holds the fixing roller 62. The external plate 93 is fixed to the internal plate 91 by the bolt 92. Both the internal plate 91 and the external plate 93 include a through-hole 94 through which the shaft 75 is inserted.

A bolt 95 is threaded through the upper surface of the internal plate 91 of the external lever 79 into the coil spring 82 to support the coil spring 82. The bolt 95 serves as a shaft to support the coil spring 82 and also serves as a stopper to regulate the upper limit position of the external lever 79. It is to be noted that the internal lever 78 is only partially illustrated in FIG. 14.

With reference to FIG. 15, a description is provided of the internal lever 78. The internal lever 78 includes through-holes 96 through which the shaft 75 is inserted, similar to the external lever 79. The internal lever 78 and the external lever 79 are connected by a screw shaft 97, inserted into a hole 91*a* (shown in FIG. 14) formed in the upper surface of the internal plate 91. The internal lever 78 and the external lever 79 are connected with a certain clearance.

As illustrated in FIG. 16, a spring washer 98 for the coil spring 82 is fixed inside the internal lever 78. A shaft pin 99 is fixed to the spring washer 98 such that the shaft pin 99 projects horizontally outside. The shaft pin 99 engages a slot 100 (shown in FIG. 14) formed in the external plate 93 of the external lever 79. With this configuration, a degree of shift of the internal lever 78 and the external lever 79 due to a change of the position of the pressing roller 62 is regulated. As illustrated in FIG. 16, the coil spring 82 is disposed between the spring washer 98 and the upper surface of the internal plate 91.

The internal lever 78 is directly and rotatably driven by the cam 77. In other words, the cam 77 changes the lowest end position of the coil spring 82.

When the cam 77 is rotated in the clockwise direction as described above, the pressing roller assembly 76 rotates upward, causing the pressing roller 62 to pressingly contact the fixing roller 54 through the fixing belt 58. After the pressing roller 62 pressingly contacts the fixing roller 54, the coil spring 82 is compressed, thereby reliably pressing the pressing roller 62 toward the fixing roller 54. Without the coil spring 82, there is no allowance in positioning of the pressing roller 62 when changing the position of the pressing roller 62. That is, the spring force of the coil spring 82 enables the pressing condition of the pressing roller 62 to change reliably between the first pressing state, the second pressing state, and so forth. The pressing roller 62 is biased (pressed) by the upper end of the coil spring 82.

According to the foregoing embodiments, the pressing position of the pressing roller 62 is changed in multiple steps, for example, the first pressing state suitable for fixing, for example, a relatively thin sheet, a no-coating sheet, and the like, and a second pressing state suitable for fixing, for example, a relatively thick sheet, a coated sheet, and the like. Alternatively, the pressing positions are not limited to two, that is, the first pressing state and the second pressing state, and the number of pressing positions may be increased by employing a stepless cam as the cam 77. In such a case, a data table for sheet types and proper pressing positions corresponding to the recording media sheets may be stored in a memory of the controller, and the proper pressing position may be selected in accordance with the types of the recording medium. An amount of rotation of the cam 77 to move the pressing roller 62 to a proper pressing position is obtained by adjusting the number of steps of the stepping motor serving as the drive source of the cam 77, for example.

According to the foregoing embodiments, the present invention is employed in the belt-type fixing device. However, the present invention may be employed in a heat-roller type fixing device and a device that conveys a sheet and supplies heat thereto.

According to the illustrative embodiment, the present invention is employed in the image forming apparatus. The image forming apparatus includes, but is not limited to, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A fixing device for fixing a toner image on a recording medium, comprising:

a fixing roller to rotate in a predetermined direction of rotation;

a pressing roller to rotate and contact an outer circumferential surface of the fixing roller to form a nip between the pressing roller and the fixing roller through which the recording medium bearing the toner image passes to fix the toner image by heat and pressure, a position of the pressing roller changeable relative to the fixing roller;

a pressing lever disposed to hold both lateral end portions of the pressing roller;

a cam disposed on a camshaft, to rotate the pressing lever to change the position of the pressing roller, with rotation of the cam in a first, pressing direction enabling the pressing roller to pressingly contact the fixing roller, and rotation of the cam in a second direction opposite the pressing direction enabling the pressing roller to separate from the fixing roller;

a cam upper limit position detector to detect an upper limit position of the cam as the cam rotates in the pressing direction of the pressing roller pressing against the fixing roller; and a controller to provide notification of an error based on a detection result provided by the cam upper limit position detector.

2. The fixing device according to claim 1, further comprising a biasing member, with one end thereof contacting the pressing lever to press the pressing roller against the fixing roller, wherein the other end of the biasing member not contacting the pressing lever is compressed to rotate the pressing lever as the cam rotates.

3. The fixing device according to claim 2, wherein the biasing member is a coil spring.

4. The fixing device according to claim 1, further comprising:

a cam position detector to detect a position of the cam;

a drive source to drive the cam based on a detection signal provided by the cam position detector; and a controller to change the position of the pressing roller in accordance with at least one of a type of the recording medium, a thickness of the recording medium, and a recording mode.

5. The fixing device according to claim 1, wherein the notification is at least one of a flashing light and a graphic or textual display.

6. A fixing device for fixing a toner image on a recording medium, comprising:

a fixing roller to rotate in a predetermined direction of rotation;

a pressing roller to rotate and contact an outer circumferential surface of the fixing roller to form a nip between the pressing roller and the fixing roller through which the recording medium bearing the toner image passes to fix the toner image by heat and pressure, a position of the pressing roller changeable relative to the fixing roller;

a pressing lever disposed to hold both lateral end portions of the pressing roller;

a cam disposed on a camshaft, to rotate the pressing lever to change the position of the pressing roller, with rotation of the cam in a first, pressing direction enabling the pressing roller to pressingly contact the fixing roller, and rotation of the cam in a second direction opposite the pressing direction enabling the pressing roller to separate from the fixing roller;

a cam upper limit position detector to detect an upper limit position of the cam as the cam rotates in the pressing direction of the pressing roller pressing against the fixing roller; and a controller to rotate the cam in the second direction opposite the pressing direction, to move the pressing roller to a different pressing position based on a detection result provided by the cam upper limit position detector.

7. An image forming apparatus, comprising the fixing device according to claim 1.

8. The fixing device according to claim 1, wherein a cam height of the cam, defined as a distance from a center of the camshaft to a circumferential cam surface, increases continuously along the pressing direction of rotation of the cam to a position where the pressing roller pressingly contacts the fixing roller.

9. The fixing device according to claim 8, wherein a rate of change in the cam height substantially near a contact portion of the cam surface contacting the pressing lever is less than or equal to 0.05 mm per degree of a cam angle θ.

10. The fixing device according to claim 6, further comprising a biasing member, with one end thereof contacting the pressing lever to press the pressing roller against the fixing roller, wherein the other end of the biasing member not contacting the pressing lever is compressed to rotate the pressing lever as the cam rotates.

11. The fixing device according to claim 10, wherein the biasing member is a coil spring.

12. The fixing device according to claim 6, further comprising:

a cam position detector to detect a position of the cam;

a drive source to drive the cam based on a detection signal provided by the cam position detector; and a controller to change the position of the pressing roller in accordance with at least one of a type of the recording medium, a thickness of the recording medium, and a recording mode.

13. An image forming apparatus, comprising the fixing device according to claim 6.

14. The fixing device according to claim 6, wherein a cam height of the cam, defined as a distance from a center of the camshaft to a circumferential cam surface, increases continuously along the pressing direction of rotation of the cam to a position where the pressing roller pressingly contacts the fixing roller.

15. The fixing device according to claim 14, wherein a rate of change in the cam height substantially near a contact portion of the cam surface contacting the pressing lever is less than or equal to 0.05 mm per degree of a cam angle θ.

* * * * *